US005281244A

United States Patent [19]

Wiand

[11] Patent Number: 5,281,244

[45] Date of Patent: * Jan. 25, 1994

[54] FLEXIBLE ABRASIVE PAD WITH RAMP EDGE SURFACE

[76] Inventor: Ronald C. Wiand, 149 Heatherwood Dr., Troy, Mich. 48098

[ * ] Notice: The portion of the term of this patent subsequent to Dec. 29, 2009 has been disclaimed.

[21] Appl. No.: 992,423

[22] Filed: Dec. 17, 1992

Related U.S. Application Data

[63] Continuation of Ser. No. 557,955, Jul. 26, 1990, Pat. No. 5,174,795, which is a continuation-in-part of Ser. No. 526,055, May 21, 1990, abandoned.

[51] Int. Cl.[5] ..... B24B 1/00

[52] U.S. Cl. ..... 51/295; 51/394; 51/398

[58] Field of Search ..... 51/295, 394, 398

[56] References Cited

U.S. PATENT DOCUMENTS

| | | | |
|---|---|---|---|
| 816,461 | 3/1906 | Gorton | 51/395 |
| 1,507,836 | 9/1924 | King | 51/398 |
| 2,907,146 | 10/1959 | Dyar | 51/195 |
| 3,048,482 | 8/1962 | Hurst | 51/298 |
| 3,098,329 | 7/1963 | Doran | 51/177 |
| 3,468,079 | 9/1969 | Kaufman | 51/378 |
| 4,078,340 | 3/1978 | Klecker et al. | 51/298 |
| 4,088,729 | 5/1978 | Sherman | 51/298 |
| 4,106,915 | 8/1978 | Kagawa et al. | 51/298 |
| 4,111,666 | 9/1978 | Kalbon | 51/298 |
| 4,554,765 | 11/1985 | Grimes et al. | 51/298 |
| 4,617,767 | 10/1986 | Ali | 51/358 |
| 4,653,236 | 3/1987 | Grimes et al. | 51/298 |
| 4,675,975 | 6/1987 | Kucharczyk et al. | 51/407 |
| 4,750,915 | 6/1988 | Tomita et al. | 51/309 |
| 4,754,580 | 7/1988 | Mattson | 51/177 |
| 4,945,687 | 8/1990 | Scheider et al. | 51/298 |

FOREIGN PATENT DOCUMENTS

| | | |
|---|---|---|
| 619539 | 5/1961 | Canada . |
| 5274990 | 6/1977 | Japan . |
| 5232480 | 8/1977 | Japan . |
| 1827 | of 1862 | United Kingdom . |
| 1243288 | 8/1971 | United Kingdom . |
| 2043501 | 10/1980 | United Kingdom . |

*Primary Examiner*—Mark L. Bell
*Assistant Examiner*—Willie J. Thompson
*Attorney, Agent, or Firm*—Harness, Dickey & Pierce

[57] ABSTRACT

A one-piece abrasive sheet and method of manufacture. The abrasive pad has a planar sheet portion with a plurality abrasive protrusion extending therefrom. The protrusions are intimately molded with the planar sheet portion to form a one-piece sheet. Thermoplastic and abrasive grit mixture may be used to form the sheet. The resulting pad has improved durability.

Also disclosed is an improved circumferentially outer lip structure with a ramp surface for improving performance of the pad over irregular surfaces or surfaces with edges or steps or the like.

12 Claims, 2 Drawing Sheets

FLEXIBLE ABRASIVE PAD WITH RAMP EDGE SURFACE

This is a continuation of U.S. patent application Ser. No. 557,955, filed Jul. 26, 1990, now U.S. Pat. No. 5,174,795 which is a continuation-in-part of U.S. Ser. No. 526,055, filed May 21, 1990, now abandoned.

BACKGROUND OF THE INVENTION

This application is a continuation-in-part of Ser. No. 526,055, filed May 21, 1990, entitled "Flexible One-Piece Diamond Sheet Material With Spaced Apart Abrasive Portions".

The present invention relates to an abrasive sheet which includes ramp edge surfaces for traversing rough work surfaces. The present invention also relates to a flexible one-piece abrasive sheet which includes spaced apart abrasive portions which may be used as polishing pads and the like, and is particularly useful for polishing of marble and stone surfaces.

In the past, the use of abrasive pads which include abrasive resinoid segments attached to backing substrates, has been common when polishing stones and marbles and other materials. Because of the relatively thick and non-yielding resinoid segments generally used in this operation, it has been problematic to provide a flexible type abrasive pad using these types of segments. In the past, these segments have been attached to backing substrates, such as fabrics or the like, utilizing a large number of small segments to produce a flexible abrasive pad. Such abrasive pads are commonly used on rotary polishers for finishing of marble floor surfaces, for instance. While these structures have been useful as rotary polishing pads, the operational life of the pads has been low. This is because of disattachment of segments during use.

Therefore, it has been a goal in the art to produce a long lasting flexible "segmented-type" abrasive sheet material which will have increased durability and be less subject to loss of abrasive portions during use.

Additionally, it has been desirable to provide an abrasive pad structure which would be resistant to damage during contact with an edge surface.

SUMMARY OF THE INVENTION

In accordance with the present invention there is provided a one-piece flexible abrasive sheet which may be in the form of a pad. The one-piece abrasive sheet includes a flexible planar sheet portion having a plurality of abrasive protrusions extending therefrom. The protrusions are intimately molded with a backing sheet from a thermoplastic material. The material includes an intimate mixture of an abrasive grit material.

The abrasive pad of the present invention provides a one-piece pad which increases the longevity of the pad during normal use, such as finishing of marble floors or flat edges and radius edges of counter tops, and reduces the amount of lost abrasive portions due to the integral molding of the portions with the substrate sheet.

Additionally, a lip structure is provided for a pad which has a ramp surface. This lip structure provides improved traversal of edge surfaces during use of the pad and thus increases the usefulness and durability of the pad.

Additional benefits and advantages of the present invention will become apparent from the subsequent description of the preferred embodiments and the appended claims taken in conjunction with the accompanying drawings.

DESCRIPTION OF THE PREFERRED EMBODIMENTS

Figure 1:
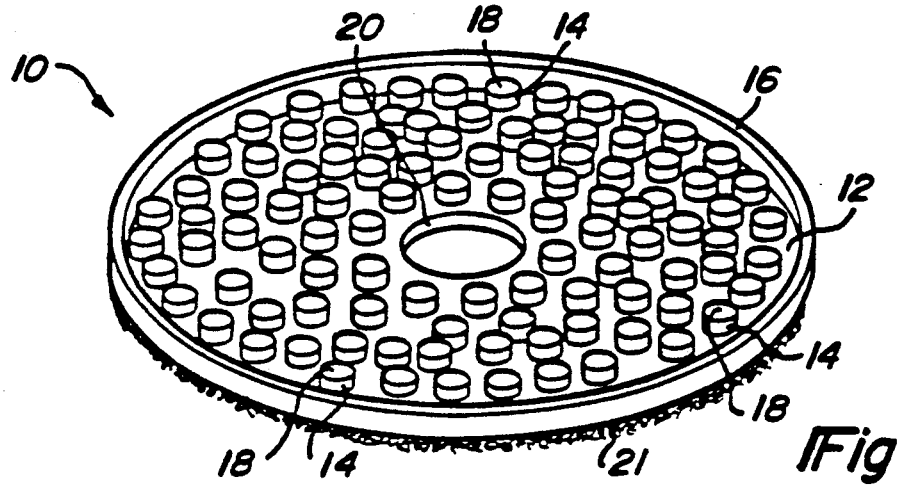
FIG. 1 is a perspective view of an abrasive pad made in accordance with the teachings of the present invention.

Referring now to the drawings, according to the present invention there is provided a flexible one-piece abrasive sheet, such as pad 10. The one-piece abrasive pad 10 includes a flexible planar sheet portion 12 which has a plurality of abrasive protrusions 14 extending therefrom. The protrusions 14 are intimately molded with the sheet portion 12. For molding of these, a thermoplastic material, thermosetting material or other moldable and curable material is used which has an intimate mixture of an abrasive grit material therein.

In a preferred embodiment of the present invention, the pad 10 is formed in a circular embodiment with a peripheral lip portion 16 extending in the same direction as the protrusions 14. The lip portion 16 advantageously allows the pad to climb over obstacles in an irregular surface without damaging the abrasive protrusions 14. The advantage of the lip portion 16 is set forth in more detail in my co-pending U.S. patent application Ser. No. 502,056 Entitled "Marble, Granite and Stone Finishing Method and Abrasive Pads Therefor", filed Mar. 30, 1990, which is incorporated herein by reference thereto. The protrusions 14 have outer abrasive end surfaces 18 which are coplanar to one another. Preferably lip 16 is also coplanar to these peripheral edges 18. The pad 10 includes a central orifice 20 which is provided for fitting on a particular rotary tool to provide clearance during use. A means for attachment to a polishing tool or mandrel, such as a Velcro® hook and loop fastener 21 is attached to the back of the pad 10. Such Velcro® attachments are common in the rotary tools used today. However, other means for attachment could readily be adapted as a particular tool required.

Figure 4:
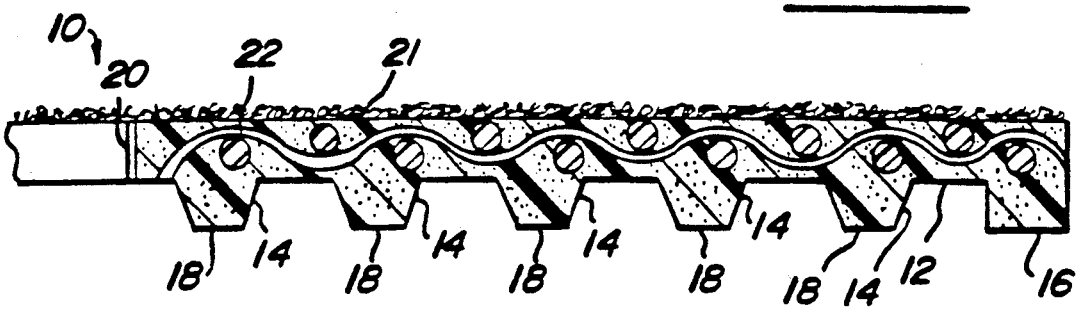
FIG. 4 is a sectional view of the abrasive pad of FIG. 1.

Referring now to FIG. 4, in a preferred embodiment a strengthening element 22 is integral with the backing portion 12. The strengthening element 22 may be any of a number of materials which have a plurality of apertures therethrough. A suitable strengthening element provides strengthening to the pad while retaining flexible characteristics of the backing portion 12 during use.

In a preferred embodiment the strengthening element 22 is a woven mesh material such as a fiberglass mesh material, as shown in FIG. 4. In the embodiment shown in FIG. 4, the mesh material is embedded in the thermoplastic during the forming of the sheet portion 12.

Figure 3:
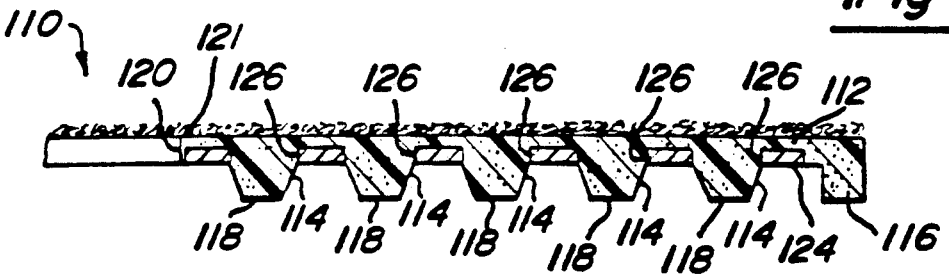
FIG. 3 is a sectional view of an alternate embodiment of an abrasive pad made in accordance with the teachings of the present invention.

Referring now to FIG. 3, there is shown an alternate embodiment of an abrasive pad, generally shown at 110. In the figures like numerals differing by 100 refer to like elements in the alternate embodiment 110. The alternate embodiment 110 is similar to the embodiment 10, however a perforated phenolic sheet material 124 is utilized as a strengthening element in place of the strengthening mesh 22. In this embodiment the thermoplastic is molded in-situ with the phenolic board such that the thermoplastic progresses through the perforations in the phenolic board material. The phenolic sheet material 124 is attached to the thermoplastic due to the compatible adhesive characteristics of the thermoplastic and the phenolic board and also due to the mechanical interlock of the protrusion 114 with the apertures 126 in the phenolic sheet material 124. A NEMA grade G-3 phenolic board, such as that utilized in circuit board applications, is a preferred material for this embodiment.

Preferably, the material used for forming the one-piece abrasive pad of the present invention is a thermosetting, thermoplastic or moldable polymer material which includes suitable abrasive particles interspersed therethrough. The material used must be sufficiently formable by melting or may have an initial liquid form, such that it may be forced to flow into and around the strengthening element. Suitable thermoplastic materials include polycarbonates, polypropylenes, nylons, polyurethanes, or other thermoplastics which can be thermomelted with heat and pressure to produce the abrasive pad 10 or 110. A preferred material is a polypropylene powdered material which may be mixed with diamond grit particles and/or silicon carbide type particles in its powdered form prior to the molding operation. Of course, other abrasive grit materials could be utilized in the present invention as will be readily appreciated by those skilled in the art.

In the past, it has generally been taught that thermoplastics are not generally useful in abrasive grit particles due to the heat and resulting decomposition and melting during use of such materials. However, in the present invention I have deviated from the prior art teachings by using thermoplastic materials which I have found to be suitable for such applications.

Figure 2:
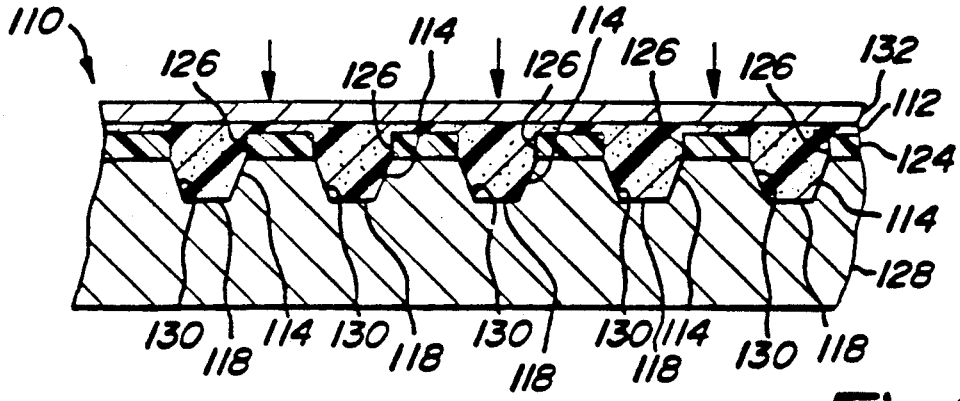
FIG. 2 is a sectional view illustrative of a process, in accordance with the teachings of the present invention, for manufacture of an abrasive pad.

Referring now to FIG. 2, in accordance with the method aspects of the present invention a lower mold platen 128 is provided which has a series of spaced indentation portions 130 corresponding to the shape of the desired protrusion in the resulting abrasive pad or sheet, such as sheet 110. An upper platen 132 is provided for placing a mixture of a thermoplastic material and an abrasive grit material under pressure, in the presence of heat, for forcing the thermoplastic and abrasive grit mixture into the indentations 130 of the mold platen 128. This forms the one-piece abrasive pad of the present invention.

Thus, in accordance with the steps of the present invention, it is first necessary to provide an intimate mixture of abrasive grit materials and a polymer material. This could be accomplished by mixing a powdered thermoplastic with an abrasive grit, by melt mixing these constituents, or by mixing the abrasive grit material in a liquid thermosetting polymer.

Thereafter, this mixture is placed in the mold platen 128 and the mixture is heated under pressure to form the resulting article 110 in the mold portion of the platen 128.

In a preferred embodiment, a strengthening element, such as the phenolic board material 124, is placed in the platen such that the orifices 126 are in the same locations as the indentations 130 of the platen 128. Thereafter, a mixture of a thermoplastic and abrasive material is placed on top of this. The platen 132 is then lowered on the above constituents in the presence of heat which thermoplastically deforms the plastic material with the abrasive grit intermixed therein and forces it through the orifices 126 and into the indentations 130 of the lower platen 128.

In an alternate embodiment, such as that shown in FIG. 4, the fiberglass or other mesh material, which is utilized as a strengthening element, may be placed on the platen 128 and thereafter the thermoplastic material is pressed through the apertures and the strengthening element to form the final abrasive pad or structure, as shown in FIG. 4.

Figure 5:
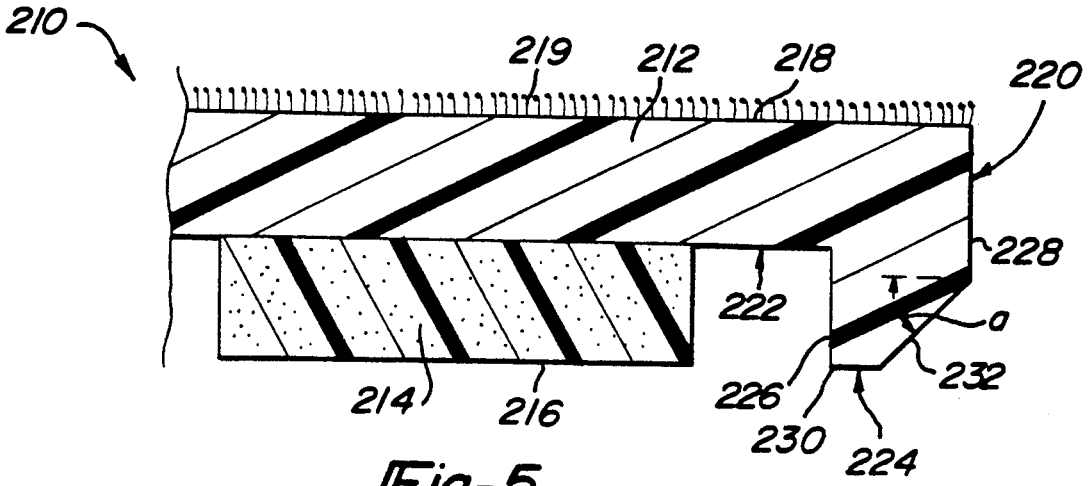
FIG. 5 is an enlarged sectional view, partially broken away, showing an advantageous ramp structure incorporated in an axially extending lip in accordance with the teachings of the present invention.
Figure 6:
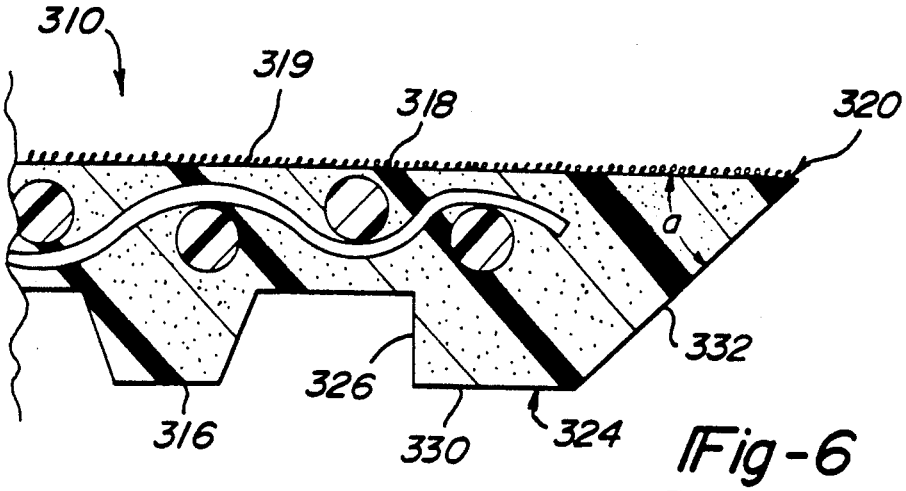
FIG. 6 is an enlarged sectional view, partially broken away, showing another embodiment of a ramp structure incorporated in an axially extending lip in accordance with the teachings of the present invention.
Figure 7:
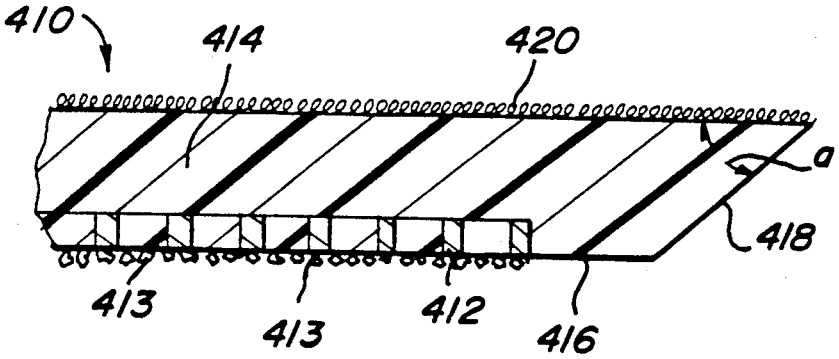
FIG. 7 is an enlarged sectional view, partially broken away, showing another embodiment of a ramp structure used in a pad having a radially extending flexible lip.

Referring now to FIGS. 5, 6 and 7, an advantageous tamp structure, in accordance with the present invention, is shown in more detail.

Referring to FIG. 5, there is shown a structure, as set forth in my previous copending application Ser. No. 502,056, which has already been incorporated herein by reference above. In accordance with the present invention, the abrasive pad 210 includes a flexible backing substrate 212 with an abrasive segment 214 attached thereto. The abrasive pad includes a front abrasive side 216 and a back side 218 with Velcro ® 219 attached. In a preferred embodiment, the pad is circular in nature and is adapted for attachment to a rotary tool mandrel or the like for rotation, ascillation or other abrading motions. The embodiment shown is rotatable about an axis. The pad body includes an outer circumference, generally indicated at 220, and is flexible in at least region 222, adjacent its outer circumference 220. A lip portion 224 is provided which extends in an axial direction from the outer circumference 220. In a preferred embodiment the lip portion is annular. The lip portion 224 includes a radially inner edge 226, a radially outer edge 228 and an axial outer edge 230. A ramp surface 232 is formed between the radially inner edge 226 and the radially outer edge 228 for assisting in traversing edges encountered in work surfaces during use of the abrasive pad. The ramp portion 232, generally speaking, extends from the radially outer edge 230 toward the back side of the pad 218, in a radially outward direction towards the edge 228.

In accordance with the present invention it has been found that the ramp angle "a" between the ramp surface 32 and the plane of the pad is from about 10° to about 60°. Typically, the angle "a" would be from about 40° to about 50°. In a preferred embodiment, the angle "a" is about 45°.

Referring now to FIG. 6, there is shown an alternate pad construction 310 incorporating the ramp feature of the present invention. The pad 310 is produced in accordance with the previous specification and is of a construction, as shown in FIG. 4. Thus, the pad includes an abrasive side 316 and a back side 318 with Velcro ® 319 attached thereto. A circumferential lip portion, generally indicated at 324 extends axially from the pad. In this embodiment the annular ramp portion 332 extends from the axially outer side 330 of the lip 324 all the way to the back 318. Thus, an extended ramp is provided as may be desirable in certain types of final applications. The angle "a" used in this embodiment is in the same angular ranges as set forth above.

The use of the above described ramp structure may also be applied to other flexible pad constructions which may or may not include an axially extending lip but which are flexible at or adjacent to the outer circumference for instance, in the pad structure shown in FIGS. 3, 4, 4*a* and 5 of my U.S. patent application Ser. No. 502,056.

Referring to FIG. 7, there is shown such a structure 410. The structure 410 has a perforated metal element 412 with abrasive grit 413 attached thereto embedded in a polymer substrate 414. The polymer substrate 414 forms a flexible lip portion 416 which extends radially from the perforated metal element 412 and has an axial thickness. The ramp structure 418 is again an annular ramp in a preferred embodiment having the same range for angle "a" as stated above. The ramp structure extends from the front abrasive side to the rear side which includes Velcro® hook and loop attachments 420. Of course, a ramp which extends only partially along the thickness of the pad, such as shown in FIG. 5, could also be utilized in the pads of FIGS. 6 or 7 or other pads having a similar flexible lip at about the outer circumference.

While the ramp structure is shown as used in an annular pad the ramp structure could be equally advantageous as used in ascillating pads or the like which may be configured in other shapes.

Thus, in accordance with the present invention the ramp like surface provides an increased benefit in rough surfaces or surfaces having edges. The present pad construction allows the lip portion to flex and to lead the pad upward along an edge without detrimentally affecting the pad. The structure is a great improvement over the prior structures utilizing only a lip edge or other flexible edge extending axially from the pad.

Further understanding of the present invention may be obtained by reference to the following example which is given as further illustration of the present invention and is riot to be construed to be limiting to the present invention.

EXAMPLE I 50 grams of polypropylene powder obtained from Himont Corporation of Troy, Michigan, product code number PC 072 PM, having a melt grade of 6 to 9, were mixed with 30 grams of a silicon carbide 600 grit abrasive material and 15 grams of a diamond 20/40 micron material. The powder and abrasive grit material were mixed and blended to form a congruous intermixed material.

A lower mold platen having a 3 ¼ inch diameter circular indentation with indentations therein for forming ⅛ inch diameter and 1/16 inch high projections and including mold portions for forming a lip ⅛ inch wide by 1/16 of an inch high was provided. A pin was provided at the center of the above mold which is ½ inch in diameter for performing the hole in the resulting abrasive pad.

13 grams of the above mixture was placed around the ½ inch pin into the bottom mold platen. On top of this a 20 mesh fiberglass material, formed 3 ¼ inches in diameter with a ½ inch center hole was placed. Thereafter, a suitable top platen was lowered on the above components and heated to 380° F. at 5 tons pressure for six minutes.

The abrasive grit and thermoplastic material melts and flows into the mold. The mold was released forming an abrasive pad with a lip portion, coplanar abrasive protrusions having abrasive grit material interspersed therein and a fiberglass reinforcement member embedded therein. The resulting pad was found to be suitable for floor polishing and edge polishing, railings, headstones, monuments and other marbles and the like.

While the above description constitutes the preferred embodiments of the present invention, it is to be appreciated that the invention is susceptible to modification, variations and change of departing from the proper scope and fair meaning of the accompanying claims.

What is claimed is:

1. An abrasive pad comprising:

an abrasive pad having a front abrasive side and a back side, said abrasive pad adapted for attachment to a mandrel of a polishing tool, said abrasive pad having an abrasive grit material for abrading of a work surface, said pad having an outer circumference, said pad being flexible at least at about its outer circumference;

a lip portion extending from said outer circumference, said lip portion including a radially inner edge and radially outer edge; and a ramp surface formed between said radially inner edge and said radially outer edge for assisting in traversing edges of a work surface encountered during use of said abrasive pad.

2. The abrasive pad of claim 1 wherein said lip portion extends in an axial direction and includes an axially outer edge and wherein said ramp portion extends from the axially outer edge toward said back side in a radially outward direction.

3. The abrasive pad of claim 2 wherein said ramp surface is formed at an angle of from about 10° to about 60° with respect to a plane of the abrasive pad.

4. The abrasive pad of claim 2 wherein said ramp surface is formed at an angle of from about 40° to about 50° with respect to a plane of the abrasive pad.

5. An abrasive pad comprising:

an abrasive pad having a front abrasive side and a back side, said abrasive pad adapted for attachment to a mandrel of a polishing tool, said abrasive pad having an abrasive grit material for abrading of a work surface, said pad having an outer circumference;

a lip portion extending from said outer circumference, said lip portion including a radially inner edge and radially outer edge; and a ramp surface formed between said radially inner edge and said radially outer edge for assisting in traversing edges of a work surface encountered during use of said abrasive pad.

6. An abrasive pad comprising:

a first abrasive side defining a substantially planar abrasive surface;

a second back side spaced therefrom;

a lip portion formed at an outer circumference of said pad, said lip portion comprising a ramp surface formed from a peripheral edge of the first abrasive side at an angle toward said second back side and outwardly therefrom, thereby forming a ramp surface for assisting in traversing edges of a work surface encountered during use of said abrasive pad.

7. The abrasive pad of claim 5 wherein said ramp surface is formed of a polymer material.

8. The abrasive pad of claim 5 wherein said ramp is formed at an acute angle of from about 10° to about 60° from said second side.

9. An abrasive article comprising:

an abrasive pad having a first abrasive side and a second back side, said pad adapted for attachment to a tool, said abrasive pad including a structure for providing an abrasive grit to a work surface, said structure having a circumference;

a ramp forming portion extending from said circumference, said portion including an inner edge and an outer edge;

a ramp surface formed between the inner edge and the outer edge for assisting in traversing an uneven work surface encountered during use of said abrasive pad.

10. The abrasive article of claim 9 wherein said ramp surface is formed of a polymeric material.

11. An abrasive article comprising:

an abrasive pad having a first abrasive side and a second backing side, said pad adapted for attachment to a tool, said abrasive pad including a structure for providing a substantially planar surface including an abrasive grit to a work surface, said surface having an outer peripheral edge;

a portion extending from said peripheral edge including an inner edge adjacent the first abrasive side and an outer edge spaced from said inner edge in a direction at least toward said second backing side;

a ramp surface formed between the inner edge and the outer edge at an angle of from about 10° to about 60° at the outer edge for assisting in traversing an uneven work surface encountered during use of said abrasive pad.

12. The abrasive article of claim 11 wherein said ramp surface is formed of a polymeric material.

* * * * *